United States Patent [19]

Uhl

[11] Patent Number: 4,947,759

[45] Date of Patent: Aug. 14, 1990

[54] PROXIMITY CONTROL SYSTEM

[75] Inventor: Robert J. Uhl, Wayne, N.J.

[73] Assignee: Tele Engineering, Inc., Newfoundland, N.J.

[21] Appl. No.: 278,852

[22] Filed: Dec. 2, 1988

[51] Int. Cl.[5] ..... B60L 23/34

[52] U.S. Cl. ..... 104/299; 246/167 D; 246/194; 246/197; 246/249

[58] Field of Search ..... 104/295, 299, 300; 180/14.6, 167; 246/63 R, 63 C, 122 R, 182 C, 187 A, 194, 197, 249, 167 D

[56] References Cited

U.S. PATENT DOCUMENTS

| | | | |
|---|---|---|---|
| 3,823,673 | 7/1974 | Wesener | 104/299 |
| 3,828,681 | 8/1974 | Christensen et al. | 104/299 X |
| 3,904,157 | 9/1975 | Kühl | 246/167 D X |

FOREIGN PATENT DOCUMENTS

| | | | |
|---|---|---|---|
| 3117655 | 11/1982 | Fed. Rep. of Germany | 246/167 D |
| 0244629 | 5/1984 | Japan | 180/167 |
| 0607976 | 12/1978 | Switzerland | 180/167 |

OTHER PUBLICATIONS

"Selecting Magnets for Reed Switch Actuation"; Lester R. Moskowitz; Automation-10-1968.

*Primary Examiner*—Robert P. Olszewski
*Assistant Examiner*—Mark T. Le
*Attorney, Agent, or Firm*—Louis S. Gillow; Elliot M. Olstein

[57] ABSTRACT

A proximity switching system comrising a plurality of self-propelled vehicles mounted in tandem on a track and carrying magnetic proximity switches for controlling the vehicle propulsion. Each vehicle has a first magnet mounted on the front end at a first position, a second magnet mounted on the back end at a second position, a first magnetic reed switch mounted on the front end at a position congruent with the second position on the back end, and a second magnetic reed switch mounted on the back end at a position congruent with the first position on the front end. A pair of electric rails are mounted next to the track. Each vehicle includes contacts for receiving voltages on the rails. A DC motor drives the vehicles on the track in one of two directions dependent on the polarity of the voltages, and for not driving the vehicles in response to the closure of the first switch when the voltage has one polarity and in response to the closure of the second switch when the voltage has an opposite polarity. The magnet on a given vehicle has two functions: first, it will close the reed switch on an approaching vehicle if it comes within a predetermined distance from the given vehicle and second, it will bias a switch mounted adjacent to the magnet on the approaching vehicle to vary the distances that the switch opens or closes. The effect of the magnet on the front of the approaching vehicle is to apply a magnetic biasing field to the switch mounted adjacent to the magnet on the approaching vehicle. The magnet on the back of the given vehicle will provide a magnetic field in the same direction and therefore additive to the magnetic biasing field at the front of the approaching vehicle which additive magnetic and magnetic biasing fields when two vehicles are in proximity will cause the switch at the front of the approaching vehicle to close and disable the drive mechanism of the approaching vehicle.

34 Claims, 2 Drawing Sheets

PROXIMITY CONTROL SYSTEM

BACKGROUND OF THE INVENTION

The present invention relates to conveyor systems and more particularly pertains to systems wherein a magnetic proximity system is used to control the operation of a plurality of self-propelled vehicles mounted for travel on a common track.

Those concerned with the development of conveyor systems that employ self-propelled vehicles riding on a common track have long recognized the need for improvements in control means for regulating the driving power of the vehicles. In general, typical vehicles employed in such conveyor systems are propelled by a self-contained electric motor that draws electric power from a pair of electric rails that run adjacent the track or other surface on which the vehicles ride. Because the vehicles cannot pass one another while on the track, some provision is generally made for regulating the speed of the electric motors in the trailing vehicles when they encounter a leading vehicle.

One example of a conveyor system in which motor vehicle speed is regulated is disclosed in U.S. Pat. No. 3,823,673. In the '673 patent, electrical contacts are provided on the front and back surfaces of the vehicles. When a trailing vehicle in the '673 patent bumps into the back end of a leading vehicle that is either stopped or slowly moving, the back contact on the leading vehicle will make electrical contact with the front contact on the trailing vehicle. This contact will be detected by circuitry in the trailing vehicle which in turn will cut off power to the self-contained motor. When contact ceases between the trailing and leading vehicles in the '673 patent, the circuitry in the trailing vehicle will detect this condition and first energize a timing device. After a predetermined time period, the circuitry will then restore power to the motor in the trailing vehicle causing that vehicle to resume its normal speed.

While the device in the '673 patent and in other similar systems have served the general purpose of maintaining reasonably efficient flow of vehicle traffic, they have not proved entirely satisfactory under all conditions of service. For example, in the '673 patent, actual contact between the tandem vehicles is necessary before power to the motor is cutoff in the trailing vehicle. Additionally, in the '673 patent, power is restored to the trailing vehicle after a predetermined time period regardless of the proximity of the leading vehicle. As such, an unsatisfactory amount of vehicle bumping and inefficiencies have been experienced which is significantly reduced in the present invention.

SUMMARY OF THE INVENTION

The general purpose of this invention is to provide a proximity control system. Another object is to provide a self-propelled conveyor system having a proximity detector system wherein the trailing vehicle detects the presence of a leading vehicle and cuts off power to the motor before any contact is made between vehicles. Also, means is provided in the proximity detector system such that power to the motor is not restored until a minimum distance has been established between adjacent vehicles. To attain this, the present invention provides a unique magnetic switching arrangement wherein a magnetic field generated by one vehicle is detected by a magnetic switch on the trailing vehicle. When these adjacent vehicles are less than a first predetermined distance apart, power will be cut off to the motor of the trailing vehicle. Also, as long as these adjacent vehicles remain less than a second distance apart, as detected by the magnetic switching arrangement, the propulsion of the trailing vehicle will not resume to normal since power will not be returned to the motor. In general, the second distance is greater than the first distance.

The exact nature of this invention as well as other objects and advantages thereof, will be readily apparent from consideration of the following specification relating to the annexed drawings in which:

DETAILED DESCRIPTION OF THE PREFERRED EMBODIMENT

Figure 1:
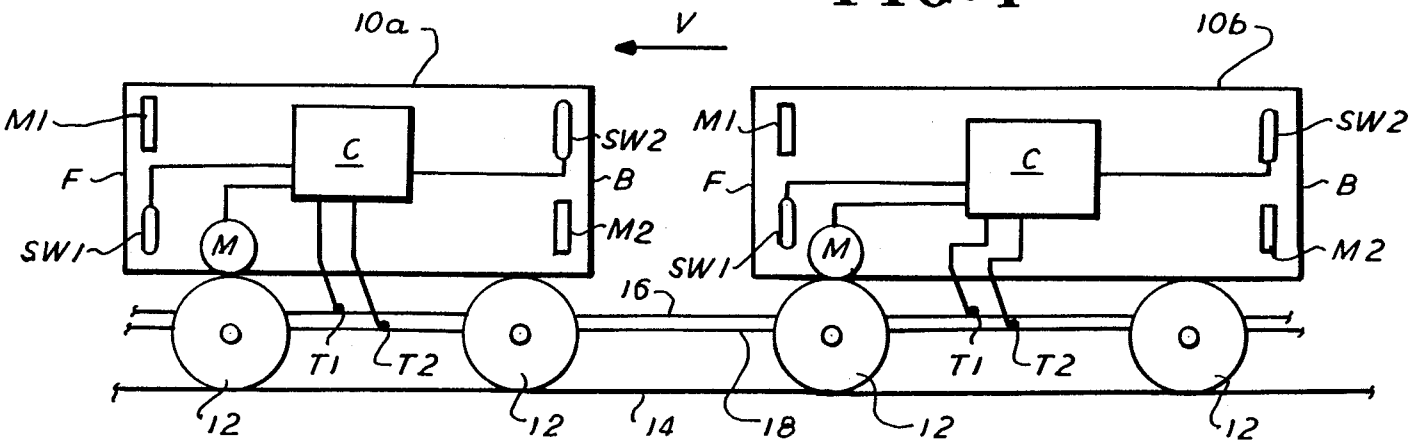
FIG. 1 is a diagrametic side elevation view of a preferred embodiment of the invention.

FIG. 1 shows a pair of vehicles 10*a*, 10*b*, each having wheels 12 that ride on a common set of tracks 14. A pair of conductive rails 16, 18 run adjacent the tracks 14. Each vehicle 10*a*, 10*b* includes a pair of conductive sliding contacts T1, T2 that extend into sliding contact with rails 16, 18, respectively. The rails 16, 18 are energized by a power source (not shown) to provide a direct current (DC) voltage thereto.

A DC motor M is mounted in each vehicle 10*a*, 10*b* for driving the wheels 12 and thereby propelling the vehicles 10*a*, 10*b* along the tracks 14. The direction of travel is determined by the polarity of the voltage on rails 16, 18.

Each vehicle 10*a*, 10*b* has a front end F and a back end B. A normally open magnetic reed switch SW1 is mounted below a permanent magnetic M1 at the front end F. A normally open magnetic reed switch SW2 is mounted above a permanent magnet M2 on the back end B. A control circuit C is mounted in each vehicle 10*a*, 10*b* and is connected to switches SW1, SW2, motor M and sliding contacts T1, T2.

The operation of the apparatus in FIG. 1 is as follows: A DC voltage is applied to rails 16, 18 for driving the vehicles 10*a*, 10*b* along track 14. The polarity of this DC voltage will determine the direction of motion of the vehicles 10*a*, 10*b*. For the present example, it will be assumed that to run vehicles 10*a*, 10*b* in the forward direction, as indicated by the direction of the arrow V, the voltage on rail 16 must be positive with respect to the voltage on rail 18. Therefore, with contact T1 positive with respect to contact T2 and with switch SW1 open, the control circuit C will apply, in a manner to be described later, a voltage of the proper size and polarity to motor M to drive the wheels 12 such that the vehicles 10*a*, 10*b* will move in the direction V on track 14. To cause the vehicles 10*a*, 10*b* to move in the direction opposite to the direction V, the polarity of the voltage on rails 16, 18 must be reversed such that contact T2 is positive with respect to contact T1. Again, the control circuit C will receive the voltage on contacts T1, T2 and, if the switch SW2 is open, apply the voltage to motor M to cause it to run in the opposite direction thereby causing the vehicles to move in a direction opposite to that of the direction V.

It is noted that the voltage applied by circuit C to motor M is derived from the voltage on contacts T1, T2 in a manner to be described later with respect to FIG. 3. It is clear that all vehicles on a particular track 14 will normally move in the same direction. It is contemplated, however, that power will be cut off to the trailing vehicle 10b if the two vehicles 10a, 10b come within a predetermined distance of each other.

More specifically, if a trailing vehicle, e.g. vehicle 10b, should come within a predetermined distance of the immediately preceding vehicle, e.g. vehicle 10a, the magnetic reed switch SW1 on the trailing vehicle, vehicle 10b, will come sufficiently close to the permanent magnet M2 on the leading vehicle, vehicle 10a, and be closed by its magnetic field. This switch closure will cause circuit C to respond by removing the voltage applied to motor M thereby permitting the speed of vehicle 10b to be reduced.

It is also noted that as vehicle 10b approaches the leading vehicle, vehicle 10a, as just described, switch SW2 on the leading vehicle, vehicle 10a, will be closed by the permanent magnet M1. However, the circuit C is arranged, as will be shown later, such that the closing of switch SW2 will have no effect on the operation of motor M in vehicle 10a.

Figure 2:
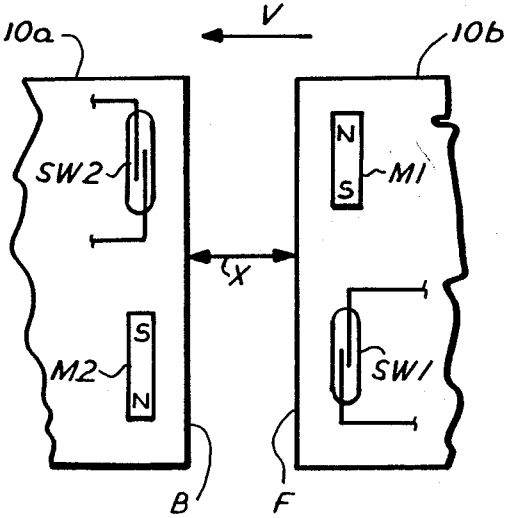
FIG. 2 is a diagrametic view of a portion of the device shown in FIG. 1.

FIG. 2 shows in greater detail the mounting configuration for the magnetic reed switches SW1, SW2 and the permanent magnets M1, M2. The back end B of vehicle 10a carries the permanent magnet M2 polarized in the vertical direction and spaced below switch SW2. The front end F of vehicle 10b carries the permanent magnet M1 polarized in the vertical direction and spaced above switch SW1. The contacts of switch SW2 are vertically aligned and in axial alignment with the polarization of magnet M2. Likewise, the contacts of switch SW1 are vertically aligned and axially aligned with the polarization of magnet M1. Magnet M1 is mounted at a height on the front of vehicle 10b equal to the height that switch SW2 is mounted on the back end of vehicle 10a. Magnet M2, on the back end of vehicle 10a, and switch SW1, on the front end of vehicle 10b, are mounted at the same height. Finally, magnets M1, M2 are polarized in opposite directions, i.e. the polarizations are antiparallel.

With the FIG. 2 arrangement, each of the switches SW1, SW2 will be effected by both magnets M1, M2. However, the magnets M1, M2 should be sufficiently spaced from the adjancent switches SW1, SW2, respectively, so as to be incapable of closing the adjacent switch. The magnets M1, M2 are located on ends B, F such that their fields, at the locations that the switches SW1, SW2 are mounted will be in the same direction and therefore additive. For example, because magnet M1 is axially aligned with the contacts of switch SW1, it will polarize the switch SW1 in the same direction that magnet M1 is polarized. Magnet M2 on a different vehicle, being polarized antiparallel to the polarization of magnet M1, will also polarize switch SW1, when sufficiently close thereto, in the same direction. Therefore, the combined effects of magnets M1, M2 on the switch SW1 will be additive. Likewise, the combined effects of magnets M1, M2 on switch SW2 will be additive.

In FIG. 2 the distance between the vehicles 10a, 10b is designated with the reference character X. Because of magnetic hysteresis, the distance X at which the switches SW1, SW2 are closed, will be substantially less than the distance X at which the switches SW1, SW2 are opened. For example, when switch SW1 is closed because of its proximity to magnet M2, the motor M in vehicle 10b will be shut down (assuming motion in the direction V). At this point, vehicle 10b will start to slow down. The motor M in vehicle 10b will not be restarted until the switch SW1 is permitted to reopen. As such, the motor M in the trailing vehicle 10b will be shut down when it comes within a first distance from the leading vehicle 10a. However, once shut down, the motor M in the trailing vehicle 10b will not be restarted until a much greater separation has been established between it and the leading vehicle 10a.

Therefore, the magnetic arrangement shown in the present invention constitutes a proximity switching arrangement wherein the proximity of two vehicles 10a, 10b cut off power to the motor M in a trailing vehicle. The distances X at which the switches SW1, SW2 are closed and then opened may be adjusted by varying the distance that the permanent magnets M1, M2 are spaced from the adjacent switches SW2, SW1, respectively. For example, by adjusting the spacing between magnet M1 and switch SW1, the sensitivity of the system may be adjusted such that the distances X are increased or decreased.

Figure 3:
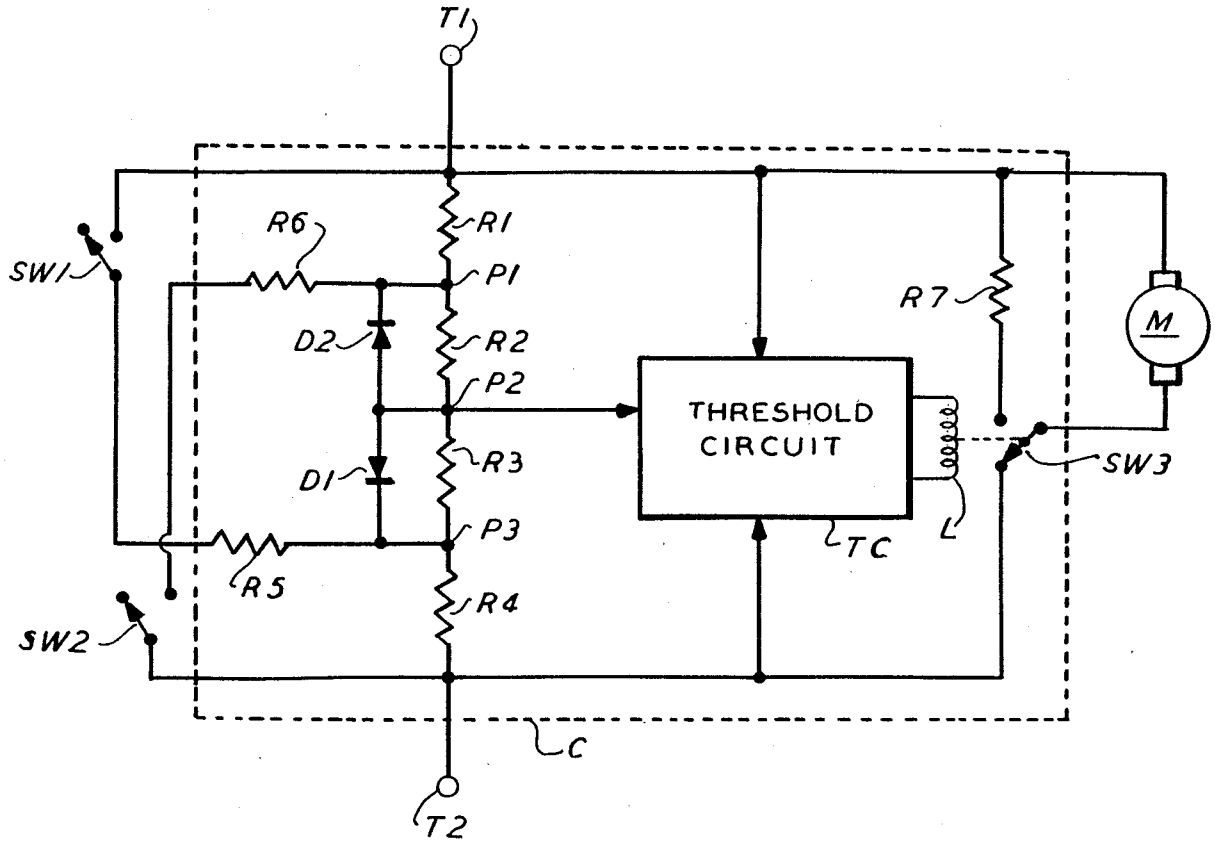
FIG. 3 is a schematic circuit diagram of a portion of the device shown in FIG. 1.

FIG. 3 shows a schematic diagram of the circuit C suitable for performing the required control functions. Contacts T1, T2 are connected by a voltage divider composed of four series connected resistors R1, R2, R3, R4. Motor M is connected across contacts T1, T2 through switch SW3 which is normally in the first position shown in FIG. 3. A pair of diodes D1, D2 are connected with opposite polarities across resistors R3, R2, respectively, at points P1, P2, P3. Magnetic reed switch SW1 and series-connected resistor R5 are connected across points P3 and contact T1. Magnetic reed switch SW2 and series-connected resistor R6 are connected across point P1 and contact T2. Point P2 and contacts T1, T2 are connected to the threshold circuit TC. The output of circuit TC normally energizes a coil L for maintaining switch SW3 in the first position (FIG. 3). When coil L is deenergized, switch SW3 moves to a second position wherein braking resistor R7 is connected across the motor M via switch SW3. The resistors R2 and R3 are equal and of a value that is much greater than resistors R1, R4, R5 and R6 which are also equal. The circuit TC, a typical threshold device, is triggered for all voltages on point P2 that are more positive than a predetermined threshold value as measured against the voltage difference between contacts T1, T2.

The operation of the FIG. 3 device is as follows: When contacts T1, T2 have sufficient DC voltage and switches SW1, SW2 are open and switch SW3 is in its first position, as shown in FIG. 3, the motor M operates to drive the vehicle using the DC voltage on contacts T1, T2. The polarity of the DC voltage will determine the direction of rotation of motor M and, therefore, the direction of travel of vehicles 10a, 10b on track 14. With T1 positive, diode D1 will conduct and short circuit resistor R3. Likewise, when contact T2 is positive, diode D2 will conduct thereby short circuiting resistor R2. In either case, the voltage at point P2 will be much less than half the voltage between contacts T1, T2.

If contact T1 is positive and switch SW1 is closed (in response to an applied magnetic field), resistor R5 will be placed in parallel across resistors R1, R2, R3 thereby increasing the voltage at point P2 to a value sufficient to trigger circuit TC. As a result, coil L will be deenergized thereby moving switch SW3 to its second position. As such, the braking resistor R7 will be placed directly across the DC motor M and the DC voltage on contacts T1, T2 will be removed from the motor M.

When the distance X becomes sufficient such that the closed switch SW1 opens to its normal position, the resistor R5 will no longer be in the circuit and the voltage at point P2 will drop below the threshold value. As such, coil L will be energized by circuit TC and switch SW3 will return to its first position thereby restoring the DC voltage on contacts T1, T2 to motor M.

Since the voltage divider network is symetric between contacts T1, T2, a similar operation will take place when contact T2 is positive and switch SW2 is closed. When contact T2 is positive, the vehicles 10*a*, 10*b* are moving in a direction opposite to the direction V and, in effect, switch SW2 is forward. Because contact T2 is positive, diode D2 conducts and the voltage at point P2 is below the threshold value. When switch SW2 is closed, resistor R6 will be connected in parallel across resistors R4, R3, R2 thereby raising the voltage at point P2 above the threshold value. Again, the circuit TC will be triggered, the coil L deenergized, the switch SW3 moved to its second position and the motor M put in parallel with the braking resistor R7.

As mentioned earlier, the switches SW1 SW2 at the rear of the leading vehicle are also closed when a trailing vehicle comes within the proper distance X thereto. However, this condition will have no effect on the motor M. For example, if contact T1 is positive and switch SW2 is closed the resistor R6 will be placed in parallel across resistors R2, R3, R4 thereby dropping the voltage at the point P2 to an even lower value than it had before the switch SW2 was closed. Therefore, the circuit TC will not be triggered and the motor M will continue to operate.

Another situation may arise when three or more vehicles are bunched and the switches SW1, SW2 on a single vehicle may be closed simultaneously. In this case, the circuit C will remove the DC voltage from motor M. For example, if T1 is positive and both switches SW1, SW2 are closed, both of the resistors R5, R6 are connected in the circuit and resistor R3 continues to be short circuited by forward biased diode D1. As such, the voltage at point P2 will increase to a value above the threshold value of circuit TC causing the coil L to move switch SW3 to its second position with the braking resistor R7 across motor M.

It should be understood, of course, that the foregoing disclosure relates to only a preferred embodiment of the invention and that numerous modifications or alterations may be made therein without departing from the spirit and the scope of the invention as set forth in the appended claims.

What is claimed is:

1. A proximity switching system comprising:

magnetic means on a first body for generating a magnetic field exterior of said first body;

detector means on a second body spaced from said first body for responding to magnetic fields generated by said magnetic means when said first and second bodies are spaced a predetermined distance;

magnetic biasing means mounted on said second body for applying to said detector a magnetic biasing field additive to said magnetic field from said first body to establish said predetermined distance; and said magnetic means and said magnetic biasing means are positioned in a manner that their polarizations are being antiparallel to one another, with the magnetic biasing means being positioned with respect to the detector means on the second body, such that the magnet field of the magnetic biasing means directly influences the operation of the detector means, so that the fields of the magnetic means and the magnetic biasing means combine to create an additive effect on the detector means on the second body.

2. A system according to claim 1 wherein said magnetic means is a permanent magnet.

3. A system according to claim 1 wherein said magnetic biasing means is a permanent magnet.

4. A system according to claim 3 wherein said detector means includes a magnetic reed switch.

5. A system according to claim 1 wherein said detector means is in a first state when said bodies are spaced said predetermined distance and changes from said first state to a second state when said bodies move from said predetermined distance to a point greater than said predetermined distance.

6. A system according to claim 5 wherein said detector means includes a magnetic reed switch.

7. A system according to claim 1 wherein said detector means is in a first state when a magnetic field greater than a first value is applied thereto and changes from said first state tot a second state when said magnetic field falls below a second value.

8. A system according to claim 7 wherein said detector means includes a magnetic reed switch having a magnetic hysteresis characteristic.

9. A system according to claim 8 wherein said magnetic biasing means is a permanent magnet mounted adjacent said magnetic reed switch whereby a biasing magnetic field is applied to said magnetic reed switch.

10. A vehicle comprising:

a vehicle body;

drive means on said vehicle body for propelling said vehicle on a surface;

first magnetic means on said body for generating a first magnetic field;

detector means on said body for detecting and responding to an applied magnetic field to alter the output of said drive means when the detector means detects and additive second magnetic means for generating a second magnetic field from another vehicle; and said first magnetic means and said second magnetic means are positioned in a manner that their polarizations are being antiparallel to one another, with the first magnetic means being positioned with respect to the detector means on the body, such that the magnetic field of the first magnetic means directly influences the operation of the detector means on the body, so that the fields of the first magnetic means and the second magnetic means are combine to create an additive effect on the detector means on the body.

11. A vehicle according to claim 10 wherein said first and second magnetic means are permanent magnets.

12. A vehicle according to claim 11 wherein said detector means includes a magnetic reed switch.

13. A vehicle comprising:

a vehicle body having front and back ends;

drive means on said vehicle body for propelling said vehicle on a surface with said front end in the forward direction when said drive means is enabled;

first magnetic means on said body at the front end for generating a first magnetic field;

detector means on said front end of said body for detecting and responding to an applied magnetic field at said front end to disable said drive means when an additive second magnetic means generating a second magnetic field is detected from the back end from another vehicle; and said first magnetic means and said second magnetic means are positioned in a manner that their polarizations are being antiparallel to one another, with the first magnetic means being positioned with respect to the detector means on the body, such that the magnetic field of the first magnetic means directly influences the operation of the detector means on the body so that the fields of the first magnetic means and the second magnetic means combine to form an additive effect on the detector means on the body.

14. A vehicle according to claim 13 wherein said first and second magnetic means are permanent magnets.

15. A vehicle according to claim 14 wherein said detector means includes a magnetic reed switch.

16. A vehicle according to claim 13 wherein:

said drive means includes means for selectively propelling said vehicle with said back end in said forward direction;

said first magnetic means generates a magnetic field exterior of said vehicle and spaced from said front end;

said detector means detects and responds to the magnetic field of said second magnetic means at said back end; and said detector means disables said drive means in response to magnetic fields detected to said vehicle end that is in said forward direction to disable said drive means when said vehicle detects the proximity of a another vehicle when either end is moving forward.

17. A vehicle according to claim 16 wherein said first and second magnetic means are permanent magnets.

18. A vehicle according to claim 17 where said detector means includes a magnetic reed switch

19. A vehicle comprising:

a vehicle body having front and back ends;

drive means on said vehicle body for propelling said vehicle on a surface with said front end in the forward direction when said drive means is enabled;

first magnetic means on the front end of said body for generating a first magnetic field;

detector means on said body for detecting and responding to a second magnetic means generating a second magnetic field from another vehicle body in proximity applied to said front end and said detector means being in a first state when combined magnetic fields greater than a first value are detected and changing from said first state to a second state when said detected combined magnetic fields fall below a second value;

means for enabling said drive means when said detector means is in said second state; and said first magnetic means and said second magnetic means are positioned in a manner that their polarizations are being antiparallel to one another, with the first magnetic means being positioned with respect to the detector means on the body, such that the magnetic field of the first magnetic means directly influences the operation of the detector means on the body, so that the fields of the first magnetic means and the second magnetic means combine to form an additive effect on the detector means on the body.

20. A vehicle according to claim 19 wherein said first and second magnetic means are permanent magnets.

21. A vehicle according to claim 20 wherein said detector means includes a magnetic reed switch.

22. A vehicle according to claim 19 wherein:

said drive means includes means for selectively propelling said vehicle with said back end in said forward direction;

said first magnetic means generates a magnetic field exterior of said vehicle and spaced from said front end;

said detector means responds to magnetic fields applied to said back end; and said detector means is in said second state in response to magnetic fields detected at one of the said vehicle ends that is not in said forward direction.

23. A vehicle according to claim 22 wherein said first and second magnetic means are permanent magnets.

24. A vehicle according to claim 23 where said detector means includes a magnetic reed switch.

25. A vehicle comprising:

a vehicle body having front end back ends;

a drive means for propelling said body;

a motor mounted in said body operatively connected to said drive means;

a first magnet mounted on said front end at a first position;

a second magnet mounted on said back end at a second position;

a first magnetic reed switch mounted on said front end at a position congruent with said second position on said back end;

a second magnetic reed switch mounted on said back end at a position congruent with said first position on said front end;

two electrical contacts mounted on and extending from said body;

an electric circuit connected to said motor, said two contacts, and said first and second switches;

said circuit having means for applying voltages on said contacts to said motor to operate said motor and for removing said voltages from said motor in response to an additive magnetic field from another vehicle body causing the closure of said first switch when said voltage has one polarity and the closure of said second switch when said voltage has a polarity opposite to said one polarity and said first magnet and said second magnet are positioned in a manner that their polarizations are being antiparallel to one another, with each magnet being positioned with respect to the adjacent switch at its end, such that the magnetic field of said each magnet directly influences the operation of said adjacent switch at its end, so that the field of the first magnet at the front end of one body and the field of the second magnet at the back end of another body in proximity combine to form an additive effect on the adjacent switches thereof.

26. A vehicle according to claim 25 wherein the field of said first magnet polarizes said first switch in a first direction and the field of said second magnet polarizes said second switch in a direction antiparallel to said first direction.

27. A vehicle according to claim 26 wherein said first and second magnets are permanent magnets.

28. A vehicle conveyor system comprising;

at least one track;

a plurality of self-propelled vehicles, having front and back ends, mounted on said track;

a voltage source operatively mounted with respect to said track;

each said vehicle having means for deriving energy from said voltage source, a drive means for propelling said vehicle with said front end in the forward direction when said drive means is enabled, a first magnetic means for generating a first magnetic field exterior of said vehicle and spaced forwardly of said front end, and a detector means on said front end for detecting the first magnetic field at said front end for enabling said drive means, and when an additive second magnetic means for generating a second magnetic field from the back end of another vehicle in proximity is detected to disable said drive means when said vehicle detects the proximity of another vehicle; and said first magnetic means at the front end and said second magnetic means at the back end are positioned in a manner that their polarizations are being antiparallel to one another, with the first magnetic means being positioned with respect to the detector means at the front end, such that the magnetic field of the first magnetic means directly influences the operation of the detector means at the front end, so that second magnetic field at the back end of one vehicle and the first magnetic field at the front end of the vehicle in proximity combine to form an additive effect on the detector means at the front end.

29. A vehicle according to claim 28 wherein:

said drive means includes means for selectively propelling said vehicle with said back end in said forward direction:

said first magnetic means generates a magnetic field exterior of said vehicle and spaced from said front end;

said detector means detects applied magnetic fields at said back end; and said detector means disables said drive means in response to magnetic fields detected at said vehicle end that is in said forward direction to disable said drive means when said vehicle detects the proximity of another vehicle.

30. A vehicle according to claim 29 wherein said first and second magnetic means are permanent magnets.

31. A vehicle according to claim 30 where said detector means includes a magnetic reed switch.

32. A vehicle conveyor system comprising:

at least one track;

a plurality of self-propelled vehicles, having front and back ends, mounted in tandem on said track;

each said vehicle having a first magnet mounted on said front end at a first position, a second magnet mounted on said back end at a second position, a first magnetic reed switch mounted on said front end at a position congruent with said second position on said back end, and a second magnetic reed switch mounted on said back end at a position congruent with said first position on said front end;

a pair of electric rails mounted next to said track;

each said vehicle including means for receiving voltages on said rails and for driving said vehicles on said track in one of two directions dependent on the polarity of said voltages, and for not driving said vehicles in response to additive magnetic fields from two vehicles in proximity causing the closure of said first switch when said voltage has one polarity and in response to the closure of said second switch when said voltage has an opposite polarity; and said first magnet and said second magnet are positioned in a manner that their polarizations are being antiparallel to one another with each magnet being positioned with respect to the switch at its end, such that the magnetic field of said each magnet directly influences the operation of said respective switch at its end, so that the magnetic field from the first magnet at the end of one body and the magnetic field from the second magnet at the end of another body in proximity combine to form an additive effect on the adjacent switches thereof.

33. A system according to claim 32 wherein the field of said first magnet polarizes said first switch in a first direction and the field of said second magnet polarizes said second switch in a direction antiparallel to said first direction.

34. A system according to claim 33 wherein said magnets are permanent magnets.

* * * * *